United States Patent [19]

Gullers

[11] Patent Number: 4,710,159

[45] Date of Patent: Dec. 1, 1987

[54] CENTRIFUGAL SEPARATOR

[75] Inventor: Per Gullers, Södertälje, Sweden

[73] Assignee: Alfa-Laval Separation AB, Tumba, Sweden

[21] Appl. No.: 876,873

[22] PCT Filed: Sep. 2, 1985

[86] PCT No.: PCT/SE85/00326

§ 371 Date: Jun. 2, 1986

§ 102(e) Date: Jun. 2, 1986

[87] PCT Pub. No.: WO86/02021

PCT Pub. Date: Apr. 10, 1986

[30] Foreign Application Priority Data

Oct. 8, 1984 [SE] Sweden ..... 8405015

[51] Int. Cl.[4] ..... B04B 11/00

[52] U.S. Cl. ..... 494/27; 494/40; 494/56

[58] Field of Search ..... 494/27, 40, 2, 38, 56; 210/781, 782

[56] References Cited

U.S. PATENT DOCUMENTS 3,825,176 7/1974 Hemfort ..... 494/40

3,825,177 7/1974 Hemfort ..... 494/40

*Primary Examiner*—Robert W. Jenkins

*Attorney, Agent, or Firm*—Cyrus S. Hapgood

[57] ABSTRACT

In a centrifugal separator for instance for purifying oil from water and solids there is a central outlet for separated water, comprising an overflow outlet maintaining a free water surface at a certain level in the door. According to the present invention this central outlet may be closed by means of an axially movable slide (23), which is rotatable together with the rotor. The rotor also has a further overflow outlet (22*a*) situated radially inside said predetermined level (20) such that upon supply of a so called displacement liquid to the rotor—in connection with the opening of periphery outlets (21) from the separation chamber for discharge of separated solids—separated water cannot leave the rotor through its outlet (12, 15) for separated oil.

5 Claims, 2 Drawing Figures

CENTRIFUGAL SEPARATOR

Figure 1:
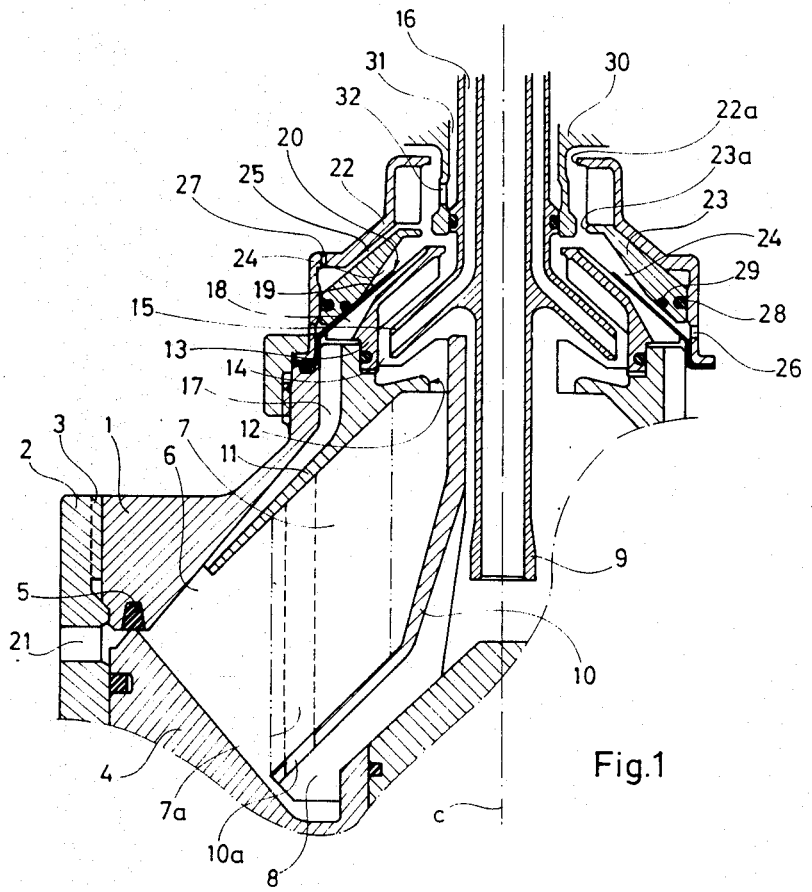

The present invention relates to a centrifugal separator the rotor of which has an inlet for a mixture of components to be separated, a first central outlet for a separated light liquid component, a second central outlet for a separated heavy liquid component, and one or more periphery outlets arranged during the operation of the rotor to be opened intermittently, said second central outlet comprising an overflow outlet arranged to maintain a free liquid surface of the separated heavy liquid component at a predetermined level within the rotor.

Centrifugal separators of this kind, known for instance by the Swedish patent specification No. 348.121 (corresponding to U.S. Pat. No. 3,752,389), are used among other things for cleaning oil from water and solids. As can be seen from said patent specification the rotor of the known centrifugal separator has a radially inwards open annular chamber situated axially outside the overflow outlet for the separated heavy liquid component, a stationary paring member being arranged successively to pump out from the rotor heavy liquid component entering the annular chamber through the overflow outlet.

Immediately before the periphery outlets are to be opened for discharge of separated solids from the separating chamber of the rotor, it is common in connection with centrifugal separators of the kind here in question to charge the rotor with a so called displacement liquid in order to displace separated light liquid component present in the separating chamber some distance radially inwards (see for instance the German patent specification DAS No. 23 63 741). The reason therefore is to reduce or avoid loss of separated light liquid component through the periphery outlets, when these are opened for the discharge of separated solids.

In order to enable displacement of the separated light liquid component upon supply of displacement liquid a valve in the outlet channel of the above mentioned paring member has to be closed or at least throttled, so that the free liquid surface in the annular chamber outside the overflow outlet may move to a level radially inside the overflow outlet.

It is thus required in a centrifugal separator of the kind now described for the displacement of the separated light liquid component, firstly, a paring member, secondly, a closing or throttling valve and, thirdly, control equipment for actuation of the valve. None of these means is fulfilling any function for the main purpose of the centrifugal separator, for instance to clean oil from water and solids.

The object of the present invention is to provide a centrifugal separator which is more simple than the described known centrifugal separator, i.e. a centrifugal separator enabling displacement of the separated light liquid component without the need of a paring member for the separated heavy liquid component, and without the need of a valve in the outlet channel of such a paring member, and its control equipment.

This object is obtained according to the invention by a centrifugal separator of the initially defined kind, which is characterized in that the rotor has an axially movable slide which is arranged to open and close, respectively, said second central outlet for the separated heavy liquid component, that the rotor has a further overflow outlet which is situated radially inside the above said predetermined level within the rotor and which is arranged to admit outflow of separated heavy liquid component from the rotor, when the slide is situated in its closing position.

The further overflow outlet in a centrifugal separator according to the invention is necessary for avoiding the risk that separated heavy liquid component should leave the rotor through the outlet for separated light liquid component. It is not necessary, however, that so much displacement liquid is supplied to the rotor in connection with opening of the periphery outlets of the rotor that the further overflow outlet is taken use of, i.e. that separated heavy liquid component does leave the rotor through the further overflow outlet.

If desired the axially movable slide may be arranged axially inside the overflow outlet, which is situated at said predetermined level. However, it is preferred that the slide is axially movable in a radially inwards open annular chamber, which is formed by the rotor axially outside the overflow outlet at said predetermined level and which is divided by the slide in two compartments, the one of which being situated closest to the just mentioned overflow outlet has an outlet at its periphery for separated heavy liquid component, and the other compartment has a throttled draining outlet at its periphery. Hereby the arrangement for the operation of the slide is made more simple.

The arrangement for the operation of the slide will be particularly simple in an embodiment of the invention which is characterized in that said further overflow outlet is formed by the rotor part which together with the slide defines said second compartment, and in that the slide has at least one centrally situated opening, the edge of which is situated radially outside the further overflow outlet. In an embodiment of this kind the slide may be operated by means of the displacement liquid to be supplied to the rotor by supply of the displacement liquid to said second compartment of the annular chamber.

Alternatively, the slide itself could form said further overflow outlet. If so, however, the arrangement for the operation of the slide would again be more complicated than if the rotor part forming said second compartment would also form the further overflow outlet.

Figure 2:
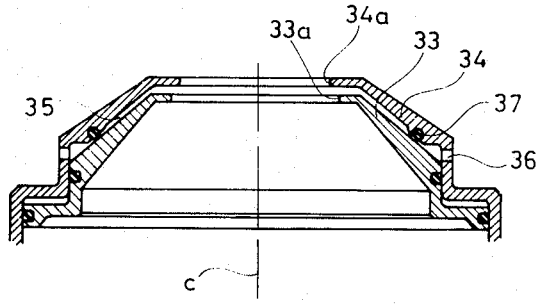

The invention will be described further in the following with reference to the accompanying drawing. In the drawing FIG. 1 shows a part of a centrifugal separator designed in accordance with the invention. FIG. 2 shows schematically an alternative arrangement for the above mentioned axially movable slide.

In FIG. 1 there is shown a centrifuge rotor comprising two parts 1 and 2, which are axially held together by means of threads 3. Radially inside the rotor part 2 there is an axially movable partition 4, which is arranged to seal against the rotor part 1 through an annular gasket 5. A separation chamber 6 is confined within the rotor between the rotor part 1 and the partition 4. The separation chamber 6, in which there is arranged a set of conical separating discs 7, has an inlet 8 for a mixture of components to be separated within the rotor. The inlet 8 communicates with the central part of the rotor, into which extends a stationary pipe 9 for the supply of said mixture. The separation discs 7 rest on a so called distributor 10 arranged to distribute incoming mixture evenly around the periphery of the separation chamber. For this purpose the distributor 10 has a number of holes 10*a* distributed around the axis of the rotor, which is designated c, and all of the separation discs 7 have holes 7*a* formed aligned with each other and with the holes 10*a*.

In the upper part of the separation chamber 6 there is a conical partition 11, which forms a central overflow outlet 12 for separated light liquid component having passed radially inwards through the disc set 7 in the separation chamber. Together with a cap 13 the partition 11 forms an annular chamber 14, into which extends a paring member 15 which is supported by the inlet pipe 9. The paring member 15 has an outlet channel 16 for the separated light liquid component.

Between the rotor part 1 and the partition 11 there is formed a channel 17, which leads from the separation chamber, radially outside the disc set 7, to a chamber 18 situated centrally in the rotor. The chamber 18 is formed between the before mentioned cap 13 and an annular conical wall 19. The radially inner edge of the wall 19 forms an overflow outlet 20 from the chamber 18 for separated heavy liquid component entering the chamber 18 from the separation chamber 6.

For the discharge of separated solids which are heavier than the two separated liquid components the rotor has a number of periphery outlet openings 21, which may be uncovered intermittently during the operation of the rotor by axial movement of the partition 4. The operating system of the rotor for said movement can be of a conventional kind and is, therefore, not shown in the drawing.

Axially outside (above) the conical wall 19 the rotor has a cap 22, which together with the wall 19 forms a radially inwards open annular chamber. In this chamber an annular slide 23 is axially movable between two end positions. The slide 23 divides the chamber into two compartments 24 and 25. The lower compartment 24 has one or more periphery outlets 26 for separated heavy liquid component, which has passed the overflow outlet 20 of the wall 19. The upper compartment 25 has a throttled outlet 27.

The slide 23 at its periphery has a gasket 28, by means of which it seals against the periphery portion of the cap 22, and at its side turned to the wall 19 it has a gasket 29, by means of which it may seal against the wall 19 a distance radially inside its outermost part. The radially inner edge of the annular slide is designated 23*a*, and the edge of the cap 22 situated radially inside this edge is designated 22*a*.

The inlet pipe 9 and the annular outlet channel 16 are surrounded by stationary members 30 forming a supply channel 31 for so called displacement liquid. The supply channel ends up at an opening 32 within the cap 22 in its upper compartment 25.

The arrangement shown in FIG. 1 operates in the following manner.

The mixed components to be separated are supplied into the rotor through the pipe 9 and enter the separation chamber 6 through the holes 10*a* in the distributor 10 and the holes 7*a* in the separation discs 7.

Separated light liquid component flows radially inwards between the separation discs 7 and leaves through the overflow outlet 12 to the chamber 14, from where it is pumped out of the rotor by means of the paring member 15. A free liquid surface is formed in the separation chamber at the level of the overflow outlet 12.

Separated heavy liquid component and heavy solids flow radially outwards within the separation chamber. The solids are collected in the radially outermost part thereof, whereas the heavy liquid component flows out through the channel 17 to the centrally situated chamber 18. From there the heavy liquid component flows further on passing the overflow outlet 20 to the compartment 24. By heavy liquid component entering the compartment 24 from the chamber 18 the slide 23 is kept in its uppermost position (as shown to the right in FIG. 1), whereby the periphery outlet openings 26 are kept uncovered for outflow of the heavy liquid component from the rotor. A free liquid surface is maintained in the chamber 18 at the level of the overflow outlet 20.

Due to the prevailing density difference between the two separated liquid components and the mutual positions of the overflow outlets 12 and 20 there is formed within the separation chamber 6 a cylindrical interface layer between the liquid components. This interface layer preferably extends immediately radially outside the separtion discs 7 during normal operation of the rotor.

When a certain time of separation has elapsed or a certain amount of solids have been collected in the separation chamber, the periphery outlets 21 have to be opened. Before this is made, there is supplied through the channel 31 and the opening 32 a so called displacement liquid, which can be constituted by previously separated heavy liquid component, to the compartment 25 situated axially outside (above) the slide 23. Only a small part of the supplied liquid flows out through the throttled outlet 27, while the rest of the liquid forces the slide 23 downwards to sealing against the wall 19 (as shown to the left in FIG. 1). The outflow of separated heavy liquid component through the outlet 26 then ceases.

Upon continued supply of displacement liquid to the compartment 25 the liquid surface therein moves radially inwards until liquid starts to overflow the inner edge 23*a* of the slide 23 and further, via the inner part of the compartment 24, into the central chamber 18 of the rotor. From there the displacement liquid flows through the channel 17 into the separation chamber 6 of the rotor and displaces therein radially inwards the separated light liquid component present within the interspaces between the separation discs 7.

The interface layer between the separated liquid components thus moves radially inwards, and the separation chamber 6 is filled more and more by displacement liquid and/or separated heavy liquid component.

When a desired degree of displacement of the separated light liquid component has been obtained, the supply of displacement liquid is interrupted, after which the periphery outlets 21 are uncovered in a known manner. Then either all or part of the content of the separation chamber may be discharged through the periphery outlets. Upon total emptying of the separation chamber the supply of mixture through the pipe 9 is cut off already before the displacement liquid is supplied.

After the supply of displacement liquid the compartment 25 is drained through the outlet 27, after which the slide 23 by the pressure of the liquid in the inner part of the compartment 24 returns to the position, in which the outlet 26 is uncovered (as shown to the right in FIG. 1).

The cap 22 of the rotor forms a further overflow outlet 22*a*, which normally need not necessarily be used. However, this overflow outlet has a position such that it would be taken use of during a displacement operation, i.e. displacement liquid would pass over it, before the interface layer between the separated liquid components in the separation chamber would have reached into the overflow outlet 12. Such a situation could occur due to incorrect dosing of displacement liquid to the compartment 25. Separated heavy liquid component can thus never flow out through the outlet for separated light liquid component.

By the arrangement of the gasket 29 of the slide 23 a distance radially inside the outermost edge of the slide, the slide 23 will be maintained in its lower position (as shown to the left in FIG. 1) as long as the compartment 25 is filled with liquid, i.e. even when the radially inner part of the compartment 24 is filled with liquid.

In FIG. 2 there is shown another arrangement of an axially movable slide according to the present invention. In this embodiment the slide, which is designated 33, is arranged in a cap 34 (corresponding to the cap 22 in FIG. 1). Between the slide 33 and the cap 34 there is formed a chamber 35, which is open radially inwards and which has a periphery outlet 36 for separated heavy liquid component. The slide 33 has a central opening with an edge 33*a*, and the cap 34 has a corresponding edge 34*a* situated radially inside the edge 33*a*. A gasket 37, corresponding to the gasket 29 in FIG. 1, is arranged to seal between the cap 34 and the slide 33 in the upper end position of the latter, as shown in FIG. 2.

In the embodiment according to FIG. 2 the slide 33 during normal operation of the rotor should be maintained (in a way not shown) in a lower end position, in which the outlet opening 36 in a chamber 35 is uncovered. The edge 33*a* of the slide then will serve as an overflow outlet for heavy liquid component separated in the rotor.

When the periphery outlets of the rotor are to be opened and, thus, displacement liquid is to be supplied, the slide 33 is moved to its position shown in FIG. 2, so that the outlet 36 is closed. In this position of the slide 33 the free liquid surface of the separated heavy liquid component within the rotor may move radially inwards to the level of the edge 34*a* of the cap, so that a desired displacement of separated light liquid component is obtained within the separation chamber of the rotor.

I claim:

1. In a centrifugal separator including a rotor having an inlet (9) for a mixture of components to be separated, a first central outlet (12, 15) for a separated light liquid component, a second central outlet (20, 26) for a separated heavy liquid component, and a peripheral outlet (21), and means (4) for opening said peripheral outlet intermittently during operation of the rotor, said second central outlet having a first overflow outlet (20) positioned to maintain a free liquid surface of the separated heavy liquid component at a predetermined level in the rotor, the improvement comprising an axially movable slide (23) movable to open and close said second central outlet (20, 26) for the separated heavy liquid component, and means forming a second overflow outlet (22*a*) located radially inside said predetermined level in position to allow discharge of separated heavy liquid component from the rotor when said slide (23) is in its closing position.

2. Centrifugal separator according to claim 1, characterized in that the slide (23) is axially movable in a radially inwards open annular chamber, which is formed by a part (22) of the rotor situated axially outside the first overflow outlet (20) at said predetermined level and which is divided by the slide (23) into two compartments (24, 25), one (24) of which is situated closest to the just mentioned overflow outlet (20) and has an outlet (26) at its periphery for separated heavy liquid component, and the other compartment (25) has a throttled draining outlet (27) at its periphery.

3. Centrifugal separator according to claim 2, characterized in that said second overflow outlet (22*a*) is formed by the rotor part (22) which together with the slide (23) defines said second compartment (25), and that the slide (23) has at least one centrally situated opening, the edge (23*a*) of which is situated radially outside the second overflow outlet (22*a*).

4. Centrifugal separator according to claim 2 or 3, comprising also supply means (31, 32) for intermittent supply to the rotor of a displacement liquid which is heavier than the separated light liquid component, characterized in that said supply means (31, 32) is arranged for the supply of displacement liquid to said second compartment (25), which has a throttled draining outlet (27) at its periphery, and that the rotor part (22) which together with the slide (23) forms said second compartment (25) also forms said second overflow outlet (22*a*).

5. Centrifugal separator according to claim 1, in which the rotor includes a part (19) forming said first overflow outlet (20) and cooperating with said axially movable slide (23) in a first position thereof to define an annular chamber (24) which opens radially inward, said annular chamber (24) having a peripheral outlet (26) for separated heavy liquid component, the slide being movable to a second position to close said peripheral outlet for separated heavy liquid component, the slide having a centrally positioned opening (23*a*) communicating with the interior of the rotor and through which separated heavy liquid component can flow when discharging from the rotor.

* * * * *